US006562766B1

(12) United States Patent
Koyama et al.

(10) Patent No.: US 6,562,766 B1
(45) Date of Patent: May 13, 2003

(54) METAL WORKING OIL COMPOSITION

(75) Inventors: Saburo Koyama, Ichihara (JP); Hiroshige Matsuoka, Ichihara (JP); Ryouichi Okuda, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 09/926,263

(22) PCT Filed: Mar. 23, 2000

(86) PCT No.: PCT/JP00/01782

§ 371 (c)(1),
(2), (4) Date: Oct. 19, 2001

(87) PCT Pub. No.: WO00/60033

PCT Pub. Date: Oct. 12, 2000

(30) Foreign Application Priority Data

Apr. 5, 1999 (JP) ..... 11-097634

(51) Int. Cl.[7] ..... C10M 105/02; C10M 169/04

(52) U.S. Cl. ..... 508/372; 508/390; 508/409; 508/481; 508/496; 72/42

(58) Field of Search ..... 508/496, 481, 508/372

(56) References Cited

U.S. PATENT DOCUMENTS

| | | | | | |
|---|---|---|---|---|---|
| 4,191,658 | A | * | 3/1980 | Jahnke | 72/42 |
| 4,832,860 | A | * | 5/1989 | Katafuchi et al. | 72/42 |
| 5,068,049 | A | * | 11/1991 | Hatano et al. | 72/42 |
| 5,176,841 | A | * | 1/1993 | Wallfahrer et al. | 508/496 |
| 5,688,750 | A | * | 11/1997 | Cooban et al. | 508/497 |
| 6,008,168 | A | * | 12/1999 | Takagi et al. | 508/485 |
| 6,136,759 | A | * | 10/2000 | Takagi et al. | 508/272 |
| 6,136,761 | A | * | 10/2000 | Takagi et al. | 508/485 |

FOREIGN PATENT DOCUMENTS

| | | |
|---|---|---|
| EP | 622 443 | 11/1994 |
| JP | 6-73392 | 3/1994 |
| JP | 7-316580 | 12/1995 |
| JP | 10-121085 | 5/1998 |
| WO | WO 97/21792 | 6/1997 |

OTHER PUBLICATIONS

Smalheer et al, Lubricant Additives, Section I–Chemistry of Additives, pp. 1–11, 1967.*

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

Provided is a metal working oil composition not containing a chlorine compound. Its working capabilities in low-speed cutting or heavy cutting operations such as broaching or gun-drilling operations are comparable to or better than those of chlorine compound-containing lubricant oil. The composition comprises 100 parts by weight of a lubricant base oil that comprises from 0 to 30% by weight of (a) a mineral base oil and from 70% to 100% by weight of (b) a π electron-containing synthetic base oil, from 0.1 to 25 parts by weight of (c) a sulfur-containing extreme-pressure agent, and from 0.1 to 7 parts by weight of (d) an alkali metal and/or alkaline earth metal sulfonate.

2 Claims, No Drawings

METAL WORKING OIL COMPOSITION

BACKGROUND OF THE INVENTION

1. Field of the Invention

The present invention relates to a metal working oil composition. Precisely, it relates to a metal working oil composition especially favorable for cutting metals.

2. Description of the Related Art

Metal working oil for cutting or grinding metals generally contains a chlorine compound as an additive. Recently, however, some problems have been pointed out with chlorine compound-containing, non-aqueous cutting oil. Specifically, when the oil is incinerated after use, it gives off dioxin and chlorine gas. The former pollutes the environment, and the latter corrodes and damages incinerators. In addition, some chlorine compounds such as chloroparaffins can be toxic and carcinogenic. In such an environment, metal working oil compositions not containing a chlorine compound are desired. Up to the present, however, no one has been able to obtain non-chlorine metal working oil compositions of which their working capabilities in low-speed cutting or heavy cutting operations are comparable to or better than those of chlorine compound-containing, metal working oil compositions.

For example, Japanese Patent Laid-Open Nos. 313182/1994 and 330076/1994 disclose cutting oil compositions that contain an alkali metal and/or alkaline earth metal sulfonate. The cutting oil compositions actually disclosed in these patent publications can be applied to lathing and boring operations, but they still involve some problems. Concretely, in low-speed cutting or heavy cutting operations for broaching or gun-drilling for which the cutting speed shall be 40 m/min or lower, their related working conditions with them must be extremely degraded. For example, a large amount of the oil composition must be used, or the pitch of cut in an operation must be reduced. If it is not, the cutting force will be high, and the cutting tools used will be broken. To that effect, it cannot be said that the working capabilities of the cutting oil compositions disclosed in these patent publications are comparable to or better than those of chlorine compound-containing, metal working oil compositions.

SUMMARY OF THE INVENTION

From the viewpoint noted above, we, the inventors, have made the present invention. The object of the invention is to provide a metal working oil composition which does not contain a chlorine compound and of which their working capabilities in low-speed cutting or heavy cutting operations, for example, in broaching or gun-drilling operations, are comparable to or better than those of chlorine compound-containing, metal working oil compositions.

We, the present inventors, have assiduously studied and, as a result, have found that, when a lubricating oil composition that contains a π electron-containing synthetic oil as the essential ingredient of the base oil is used in cutting metals, it shows improved working capabilities in cutting operations and the necessary cutting force can be reduced. On the basis of this finding, we have completed the present invention.

Specifically, the subject matter of the invention includes the following:

(1) A metal working oil composition comprising 100 parts by weight of a lubricant base oil that is comprised of from 0 to 30% by weight of (a) a mineral base oil, and from 70% to 100% by weight of (b) a π electron-containing synthetic base oil, from 0.1 to 25 parts by weight of (c) a sulfur-containing extreme-pressure agent, and from 0.1 to 7 parts by weight of (d) an alkali metal and/or alkaline earth metal sulfonate.

(2) The metal working oil composition as in the above (1), which further contains from 0.1 to 7 parts by weight of (e) a zinc dithiophosphate.

(3) The metal working oil composition as in the above (1) or (2), wherein the component (b) is a compound having carbon-carbon and/or carbon-oxygen multiple bonds.

(4) The metal working oil composition as in any of the above (1) to (3), wherein the π electron content of the component (b) falls between 0.001% and 50%.

(5) The metal working oil composition as in any of the above (1) to (4), wherein the component (b) is at least one compound selected from esters, olefins, aromatic compounds and acetylenes.

DETAILED DESCRIPTION OF THE INVENTION

The invention is described in detail hereinunder.

In the metal working oil composition of the invention, the lubricant base oil is comprised of from 0 to 30% by weight of (a) a mineral base oil and from 70% to 100% by weight of (b) a π electron-containing synthetic base oil.

The mineral base oil of the component (a) may be any ordinary one generally used in metal working oil, and is not specifically defined. Preferably, however, it has a kinematic viscosity at 40° C. of from 1 to 100 $mm^2$/sec, more preferably from 3 to 50 $mm^2$/sec. Base oil having too high kinematic viscosity is not preferred as being uneconomical, since the amount of it that may adhere to the objects being worked and may be therefore carried off by the worked objects will increase. Contrary to this, base oil having too low kinematic viscosity is also not preferred, since such gives off mist when used in cutting operations, and will therefore worsen the working environment. The pour point of the base oil is not specifically defined, but is preferably not higher than −10° C. Mineral base oils of that type include, for example, distillate oils as obtained through normal pressure distillation of paraffin base crude oils, intermediate base crude oils or naphthene base crude oils as obtained through reduced pressure distillation of the oily residues from such normal pressure distillation, as well as purified oils as obtained through purification of those distillate oils, such as solvent-purified oils, hydrogenation-purified oils, dewaxed oils, clay-processed oils, etc.

As the π electron-containing synthetic base oil of the component (b), usable are compounds having at least one π bond in the molecule. Of the compounds, preferred are those having carbon-carbon and/or carbon-oxygen multiple bonds. More preferred are those of which the π electron content represented by the following formula falls between 0.001% and 50%, even more preferably between 1% and 20%.

$$\pi \text{ electron content } (\%) = [\text{number of double bonds} + \text{number of triple bonds} \times 2] \times 100 / [\text{number of single bonds} + \text{number of double bonds} \times 2 + \text{number of triple bonds} \times 3]$$

Compounds of which the π electron content is too small are not preferred, since the metal working oil composition comprising such compounds cannot satisfactorily adhere to the newly appearing cross sections of the metal object being cut (that is, the new surfaces of the pieces of the metal object having been cut), and therefore cannot fulfill the effect of the invention. In other words, the working capabilities of the composition in low-speed cutting or heavy cutting operations cannot become comparable to or better than those of chlorine-containing, metal working oil compositions. Contrary to this, compounds of which the π electron content is too large are also not preferred, since the base oil comprising such compound loses its chemical stability, and will therefore be unsuitable for metal working oil compositions.

In the above formula, single bonds, double bonds and triple bonds are not limited to carbon-carbon bonds and carbon-oxygen bonds, but shall encompass all bonds in the compound, including carbon-hydrogen bonds and others.

The kinematic viscosity and the pour point of the component (b) are not specifically defined, but preferably fall within the ranges defined for the component (a) as above.

Concretely, the component (b) includes esters such as acetates, propionates, butyrates, valerates, caproates, caprates, caprylates, laurates, oleates, myristates, palmitates, behenates, natural oils and fats, oxalates, malonates, succinates, adipates, maleates, fumarates, acetylene-dicarboxylates, benzoates, toluates, phthalates, trimellitates, pyromellitates, etc.; olefins such as 1-octene, 1-decene, 2-decene, 3-decene, 4-decene, 1-dodecene, 1-tetradecene, 1-hexadecene, 1-octadecene, 1-eicosene, diisobutylene, triisobutylene, tetraisobutylene, tripropylene, tetrapropylene, pentapropylene, cyclooctene, cyclodecene, cyclododecene, cyclohexadecene, cycloeicosene, cyclooctadiene, cyclooctatetraene, cyclododecadiene, cyclododecatriene, alkylnorbornenes, alkylnorornadienes, etc.; aromatic compounds such as alkylbenzenes, alkylnaphthalenes, etc.; acetylenes such as 1-decyne, 1,4-butynediol, etc. these, preferred are esters, and more preferred are maleates, fumarates, acetylene-dicarboxylates, phthalates, trimellitates, and pyromellitates.

Regarding the ratio of the component (a) to the component (b) in the base oil, the component (a) accounts for from 0 to 30% by weight and the component (b) accounts for from 70% to 100% by weight. If there is too much component (a), it is undesirable, since such an oil composition cannot possess good working capabilities (that is, the oil composition cannot exhibit good lubricity in metal cutting operations).

The other components (c) and (d) and the optional component (e) that shall be added to the lubricant base oil are described below.

Component (c):

Component (c) is a sulfur-containing extreme-pressure agent. Containing sulfur atom(s) in the molecule, this is not specifically defined so long as it can dissolve or uniformly disperse in the lubricant base oil, and can exhibit the extreme-pressure effect. This includes, for example, sulfurized oils and fats, sulfurized fatty acids, sulfurized esters, sulfurized olefins, dihydrocarbyl polysulfides, thiocarbamates, thioterpenes, dialkylthio dipropionates, etc. The sulfurized oils and fats are obtained by reacting sulfur or a sulfur-containing compound with oils and fats (e.g., lard oil, whale oil, vegetable oil, fish oil, etc.), and their sulfur content is not specifically defined. In general, however, preferred are those having a sulfur content of from 5% to 30% by weight. Specific examples include sulfurized lard, sulfurized rapeseed oil, sulfurized castor oil, sulfurized soybean oil, sulfurized rice bran oil, etc. Examples of the sulfurized fatty acids include sulfurized oleic acid, etc.; those of the sulfurized esters include sulfurizedmethyl oleate, sulfurized octyl esters of rice bran fatty acids, etc.

The sulfurized olefins include, for example, compounds of a general formula (I):

$$R^1—S_x—R^2 \quad (I)$$

wherein $R^1$ represents an alkenyl group having from 2 to 15 carbon atoms; $R^2$ represents an alkyl or alkenyl group having from 2 to 15 carbon atoms; and x represents an integer of from 1 to 8.

The compounds are obtained by reacting an olefin having from 2 to 15 carbon atoms or its di- to tetra-mer with a sulfurizing agent such as sulfur, sulfur chloride or the like. As the olefin, preferred are propylene, isobutene, diisobutene, etc.

The dihydrocarbyl polysulfides are compounds of a general formula (II):

$$R^3—S_y—R^4 \quad (II)$$

wherein $R^3$ and $R^4$ each represent an alkyl or cyclic alkyl group having from 1 to 20 carbon atoms, an aryl group having from 6 to 20 carbon atoms, an alkylaryl group having from 7 to 20 carbon atoms, or an arylalkyl group having from 7 to 20 carbon atoms, and wherein $R^3$ and $R^4$ may be the same or different; and y represents an integer of from 2 to 8.

The compounds of formula (II) where $R^3$ and $R^4$ are alkyl groups are referred to as alkyl sulfides.

Specific examples of $R^3$ and $R^4$ in formula (II) include a methyl group, an ethyl group, an n-propyl group, an isopropyl group, an n-butyl group, an isobutyl group, a sec-butyl group, a tert-butyl group, all types of pentyl groups, all types of hexyl groups, all types of heptyl groups, all types of octyl groups, all types of nonyl groups, all types of decyl groups, all types of dodecyl groups, a cyclohexyl group, a cyclooctyl group, a phenyl group, a naphthyl group, a tolyl group, a xylyl group, a benzyl group, a phenethyl group, etc.

As preferred examples of the dihydrocarbyl polysulfides, mentioned are dibenzyl polysulfides, di-tert-nonyl polysulfides, didodecyl polysulfides, di-tert-butyl polysulfides, dioctyl polysulfides, diphenyl polysulfides, dicyclohexyl polysulfides, etc.

The thiocarbamates include, for example, zinc thiocarbamate, etc. The thioterpenes include, for example, reaction products of phosphorus pentasulfide and pinene. The dialkylthio dipropionates include, for example, dilaurylthio dipropionate, distearylthio dipropionate, etc.

Of these, preferred are dihydrocarbyl polysulfides, as exhibiting good extreme-pressure characteristics.

In the invention, one or more of such sulfur-containing extreme-pressure agents may be used for the component (c), either singly or as combined. The amount of the component (c) to be in the oil composition of the invention falls between 0.1 and 25 parts by weight, but preferably between 1 and 15 parts by weight, relative to 100 parts by weight of the lubricant base oil. If the amount of the component (c) therein is too small, the composition cannot exhibit good working capabilities in cutting operations; but even if the amount is made to be more, the working capabilities of the composition will be no more improved.

Component (d):

The alkali metal sulfonate and the alkaline earth metal sulfonate for the component (d) preferably have a total base value (as measured according to the perchloric acid method in JIS K-2501) falling between 0.1 and 800 mg KOH/g, more preferably between 1 and 600 mg KOH/g. If the total base value of the sulfonate is too small, the oil composition cannot exhibit good working capabilities in cutting and grinding operations, and the pitch of cut cannot be increased. On the other hand, if the total base value of the sulfonate is too large, this is unfavorable, since the oil composition will form precipitates.

The alkali metal sulfonate indicates alkali metal salts of various types of sulfonic acids. The sulfonic acids include aromatic petroleum sulfonic acids, alkylsulfonic acids, arylsulfonic acids, alkylarylsulfonic acids, etc. Concretely mentioned are dodecylbenzenesulfonic acids, dilaurylcetylbenzenesulfonic acids, paraffin wax-substituted benzenesulfonic acids, polyolefin-substituted benzenesulfonic acids, polyisobutylene-substituted benzenesulfonic acids, naphthalenesulfonic acids, etc.

The alkali metal to form the alkali metal sulfonate includes sodium, potassium, cesium, etc. Preferred is sodium, in view of the ability of its sulfonates to improve the working capabilities of the oil composition in cutting operations.

The alkaline earth metal sulfonate indicates alkaline earth metal salts of various types of sulfonic acids. The sulfonic acids include aromatic petroleum sulfonic acids, alkylsulfonic acids, arylsulfonic acids, alkylarylsulfonic acids, etc. Concretely mentioned are dodecylbenzenesulfonic acids, dilaurylcetylbenzenesulfonic acids, paraffin wax-substituted benzenesulfonic acids, polyolefin-substituted benzenesulfonic acids, polyisobutylene-substituted benzenesulfonic acids, naphthalenesulfonic acids, etc.

The alkaline earth metal to form the alkaline earth metal sulfonate includes calcium, barium, magnesium, etc. Preferred is calcium, in view of the ability of its sulfonates to improve the working capabilities of the oil composition in cutting operations.

In the invention, one or more such sulfonates may be used for the component (d), either singly or as combined. The amount of the component (d) to be in the oil composition of the invention falls between 0.1 and 7 parts by weight, but preferably between 1 and 5 parts by weight, relative to 100 parts by weight of the lubricant base oil. If the amount of the component (d) therein is too small, the composition cannot exhibit good working capabilities in cutting operations; but if too large, it is unfavorable, since the excessive component (d) will interfere with the effect of the component (b), π electron-containing synthetic oil, which is to improve the adsorbability of the oil composition to the newly appearing cross sections of the metal object being cut.

Component (e):

The component (e), zinc dithiophosphate, is an extreme-pressure additive, and is not always indispensable to the composition of the invention. However, when combined with the component (c), sulfur-containing extreme-pressure agent, it often exhibits a synergistic effect to augment the activity of the component (c).

Typically, compounds of the following general formula (III) are used as the component (e).

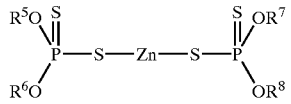

(III)

wherein $R^5$ to $R^8$ each represent a primary alkyl group having from 3 to 12 carbon atoms, a secondary alkyl group having from 3 to 12 carbon atoms, or an alkyl-substituted aryl group having alkyl group of from 3 to 18 carbon atoms; and $R^5$ to $R^8$ may be the same or different.

In formula (III) indicating zinc dithiophosphates, $R^5$ to $R^8$ are preferably primary alkyl groups, since the compounds are not easily degraded thermal oxidation. On the other hand, compounds where $R^5$ to $R^8$ are secondary alkyl groups have the ability to further improve the lubricity of the oil composition. Therefore, combining those having secondary alkyl groups with the others having primary alkyl groups is preferred for use in the invention.

One or more such zinc dithiophosphates may be used for the component (e), either singly or as combined.

The amount of the component (e) to be in the oil composition of the invention may fall between 0.1 and 7 parts by weight, but preferably between 1 and 5 parts by weight, relative to 100 parts by weight of the lubricant base oil.

Regarding the total base value of the metal working oil composition of the invention, if it is too small, the composition cannot exhibit good working capabilities in cutting and grinding operations; but if too large, it is unfavorable, since the oil composition will form precipitates. Therefore, the total base value of the composition is preferably so controlled that it can fall between 1 and 75 mg KOH/g (as measured according to the perchloric acid method in JIS K-2501), more preferably between 3 and 30 mg KOH/g.

The composition of the invention may be obtained by adding the components (c) and (d) or the components (c) to (e) to the lubricant base oil. In general, various known additives may be added to the composition without interfering with the object of the invention, in order that the composition can be made to have the basic capabilities necessary for metal working oil. For example, phosphorus-containing extreme-pressure agents such as phosphates and phosphites are typical additives. The amount of the extreme-pressure additive to be in the composition preferably falls between 0.1 and 30 parts by weight. The other known additives include oily agents such as oleic acid, stearic acid, dimer acids and other carboxylic acids or their esters; abrasion inhibitors such as zinc dithiocarbamate (ZnDTC), sulfurized oxymolybdenum dithiocarbamate (MoDTC), nickel dithiophosphate (NiDTP), nickel dithiocarbamate (NiDTC), etc.; amine-type or phenolic antioxidants; metal inactivators such as thiadiazoles, benzotriazoles, etc.; sludge dispersants such as alkenylsuccinic acids or their esters and imides, etc.; rust inhibitors such as sorbitan esters, neutral alkaline earth metal sulfonates, phenates, salicylates, etc.; anti-foaming agents such as dimethylpolysiloxanes, polyacrylates, etc.

EXAMPLES

The invention is described in more detail with reference to the following Examples, which, however, are not intended to restrict the scope of the invention.

Examples 1, 2, Comparative Examples 1, 2, and Reference Example 1

The components shown in Table 1 below were added to the base oil in the ratio indicated therein to prepare the cutting oil compositions of the Examples and Comparative Examples. These compositions were tested for their working capabilities by cutting work at its edges in the manner mentioned below, for which was used a high-performance precision lathe, Model LP (from Ohkuma of Japan). The test results are given in Table 2.

Cutting Conditions

Cutting speed: 7 m/min.

Feed rate: 0.025 mm/revolution.

Depth of cut: 2 mm.

Subject to be cut: semi-cylindrical work of JIS S45C (forged), having an outer diameter of 3 cm.

Cutting tool: JIS SKH51; rake angle=0°, clearance angle=1°.

Evaluation: The oil compositions tested were evaluated from the cutting force and the feed force which the tool received. Oil compositions for which the difference between the maximum value and the minimum value of the force is smaller are better, as exhibiting better working capabilities in cutting operations.

TABLE 1

| | Example 1 | Example 2 | Comp. Ex. 1 | Comp. Ex. 2 | Ref. Ex. 1 |
|---|---|---|---|---|---|
| Blend Ratio wt. % | | | | | |
| Mineral oil*1 | — | — | 87 | 67 | 50 |
| Dibutyl maleate*2 | 87 | — | — | 20 | — |
| Trioctyl Trimellitate*3 | — | 87 | — | — | — |
| Dihydrocarbyl polysulfide*4 | 10 | 10 | 10 | 10 | 10 |
| Ca sulfonate*5 | 3 | 3 | 3 | 3 | — |
| Chlorinated Paraffin | — | — | — | — | 50 |

Notes:
*1: Distillate of paraffin base crude oil was purified through hydrogenation, and has a kinematic viscosity of 10 $mm^2$/sec.
*2: π electron content (%) is 8.1%.
*3: π electron content (%) is 6.1%.
*4: Di-tert-nonyl polysulfide.
*5: This has a total base value of 400 mg KOH/g.

TABLE 2-1

Data of Cutting Force (unit: N)

| | Example 1 | | Example 2 | | Comparative Example 1 | |
|---|---|---|---|---|---|---|
| | Cutting Force | Feed Force | Cutting Force | Feed Force | Cutting Force | Feed Force |
| Length of Cut mm | | | | | | |
| 2.5 | 247 | 120 | 239 | 121 | 194 | 190 |
| 7.5 | 238 | 118 | 265 | 148 | 219 | 112 |
| 12.5 | 247 | 125 | 227 | 111 | 193 | 87 |
| 17.5 | 239 | 118 | 215 | 108 | 181 | 80 |
| 22.5 | 223 | 101 | 199 | 91 | 170 | 74 |
| 27.5 | 209 | 87 | 189 | 86 | 174 | 70 |
| 32.5 | 203 | 83 | 188 | 83 | 171 | 70 |
| Maximum Value | 247 | 125 | 265 | 148 | 294 | 190 |
| Minimum Value | 203 | 83 | 188 | 83 | 171 | 70 |
| Difference | 44 | 42 | 77 | 65 | 123 | 120 |

TABLE 2-2

Data of Cutting Force (unit: N)

| | Comparative Example 2 | | Reference Example 1 | |
|---|---|---|---|---|
| | Cutting Force | Feed Force | Cutting Force | Feed Force |
| Length of Cut mm | | | | |
| 2.5 | 261 | 146 | 217 | 130 |
| 7.5 | 238 | 125 | 226 | 143 |
| 12.5 | 179 | 83 | 184 | 108 |
| 17.5 | 166 | 72 | 175 | 102 |

TABLE 2-2-continued

Data of Cutting Force (unit: N)

| | Comparative Example 2 | | Reference Example 1 | |
|---|---|---|---|---|
| | Cutting Force | Feed Force | Cutting Force | Feed Force |
| 22.5 | 149 | 65 | 168 | 94 |
| 27.5 | 160 | 73 | 155 | 84 |
| 32.5 | 158 | 69 | 164 | 90 |
| Maximum Value | 261 | 146 | 226 | 143 |
| Minimum Value | 149 | 65 | 155 | 84 |
| Difference | 112 | 81 | 71 | 59 |

As described above, the metal working oil composition of the invention does not contain a chlorine compound and is suitable for low-speed cutting or heavy cutting operations such as broaching or gun-drilling operations.

What is claimed is:

1. A metal oil composition for cutting metals comprising 100 parts by weight of a lubricant base oil that comprises from 0 to 30% by weight of (a) a mineral base oil and from 70% to 100% by weight of (b) at least one synthetic base oil selected from the group consisting of 1-octene, 1-decene, 2-decene, 3-decene, 4-decene, 1-dodecene, 1-tetradecene, 1-hexadecene, 1-octadecene, 1-eicosene, diisobutylene, triisobutylene, tetraisobutylene, tripropylene, tetrapropylene, pentapropylene, cyclooctene, cyclodecene, cyclododecene, cyclohexadecene, cycloeicosene, cyclooctadiene, cyclooctatetraene, cyclododecadiene, cyclododecatriene, alkylnorbomenes, alkylnorbomadienes, alkylbenzenes, alkylnaphthalenes, 1-decyne, 1,4-butynediol, dibutyl maleate and trioctyl trimellitate, and from 0.1 to 25 parts by weight of (c) one or more sulfur-containing extreme-pressure agent(s), and from 0.1 to 7 parts by weight of (d) one or more alkali metal and/or alkaline earth metal sulfonate(s).

2. The metal oil composition as claimed in claim 1, which further comprises from 0.1 to 7 parts by weight of (e) one or more zinc dithiophosphate(s).

* * * * *

UNITED STATES PATENT AND TRADEMARK OFFICE

CERTIFICATE OF CORRECTION

PATENT NO. : 6,562,766 B1
DATED : May 13, 2003
INVENTOR(S) : Koyama et al.

It is certified that error appears in the above-identified patent and that said Letters Patent is hereby corrected as shown below:

Title page,
Item [75], Inventors, should read:
-- [75] Inventors: Saburo Koyama, Ichihara (JP);
Hiroshige Matsuoka, Ichihara (JP);
Ryoichi Okuda, Ichihara (JP) --

Signed and Sealed this

Second Day of September, 2003

JAMES E. ROGAN
*Director of the United States Patent and Trademark Office*